US006161064A

United States Patent [19]

Strasser et al.

[11] Patent Number: 6,161,064

[45] Date of Patent: Dec. 12, 2000

[54] METHOD OF INFLUENCING THE INFLECTION ANGLE OF RAILWAY VEHICLE WAGONS, AND RAILWAY VEHICLE FOR CARRYING OUT THIS METHOD

[75] Inventors: Andreas Strasser, Nürnberg; Ulrich Hachmann, Pyrbaum, both of Germany

[73] Assignee: ABB Daimler-Benz Transportation (Technology) GmbH

[21] Appl. No.: 09/117,638

[22] PCT Filed: Nov. 11, 1997

[86] PCT No.: PCT/EP97/06249

§ 371 Date: Dec. 1, 1998

§ 102(e) Date: Dec. 1, 1998

[87] PCT Pub. No.: WO98/24676

PCT Pub. Date: Jun. 11, 1998

[30] Foreign Application Priority Data

Dec. 4, 1996 [DE] Germany ..... 196 54 862

[51] Int. Cl.[7] ..... B61F 5/38; B61F 5/44; B61D 3/10

[52] U.S. Cl. ..... 701/19; 105/3

[58] Field of Search ..... 701/19; 105/3, 105/168

[56] References Cited

U.S. PATENT DOCUMENTS

| | | | |
|---|---|---|---|
| 4,289,075 | 9/1981 | Smith | 105/4.4 |
| 4,819,566 | 4/1989 | Smith et al. | 105/168 |

FOREIGN PATENT DOCUMENTS

| | | |
|---|---|---|
| 0374290 | 6/1990 | European Pat. Off. . |
| 0692421 | 1/1996 | European Pat. Off. . |
| 2123876 | 11/1972 | Germany . |
| 2854776 | 7/1980 | Germany . |
| 3327240 | 2/1984 | Germany . |
| 3330387 | 4/1984 | Germany . |
| 3615071 | 11/1987 | Germany . |
| 4012699 | 10/1991 | Germany . |
| 19526865 | 10/1996 | Germany . |

*Primary Examiner*—Michael J. Zanelli
*Attorney, Agent, or Firm*—Webb Ziesenheim Logsdon Orkin & Hanson, P.C.

[57] ABSTRACT

A multiple-unit railway vehicle having three car bodies where the respective neighboring car bodies are each connected in a pivoting manner to one another by means of a single coupling, and each car body sits only on one two-axle truck. In the vicinity of the respective center pivot and possibly also on the trucks, there are actuator elements that are used to influence the articulation angle between the longitudinal axes of the car bodies. To control the articulation angle so that when the train is traveling over a curved segment of track, the car bodies assume a position in relation to one another that corresponds at least to a significant extent to the static rest position of the railway vehicle on the corresponding section of track, the profile and curvature of the track are determined during travel for the segment of the track that currently lies between the first and last trucks, and from that measurement, the set point position is determined, and by means of the actuator system measurements are taken to counteract at least an overshooting or undershooting of the set point value.

20 Claims, 3 Drawing Sheets

METHOD OF INFLUENCING THE INFLECTION ANGLE OF RAILWAY VEHICLE WAGONS, AND RAILWAY VEHICLE FOR CARRYING OUT THIS METHOD

BACKGROUND OF THE INVENTION

1. Field of the Invention

This invention relates to a method for influencing the articulation angle between the longitudinal axes of neighboring car bodies of a multiple-unit railway vehicle traveling on a track and a railway vehicle for the implementation of this method.

2. Description of the Prior Art

To influence the articulation angle between the longitudinal axes of adjacent car bodies of a multiple unit railway vehicle traveling on a track, the prior art (DE 28 54 776 A1) teaches that the torsion of the longitudinal axis of a car body is measured with respect to the corresponding truck, and as a function of said measurement, a system of actuators in the form of hydraulically pressurized cylinders is controlled by means of a control unit. This system of actuators acts electrically on the control unit and mechanically between the ends of the neighboring car bodies that are connected to one another by means of a single center pivot. The system of actuators is controlled so that the two-axle trucks, which do not have a truck center pin and on which the car bodies are supported by means of elastic secondary springs, are completely freed of the function of force dispensers, and the wear of the wheel flanges and the rails is significantly reduced. In this case, when the train is traveling on a straight section of track, the system of actuators blocks the center pivot in one position over the center of the track, and when the train rounds a curve, forces the center pivot to buckle toward the outside of the curve of the track. The purpose of this restricted excursion is to achieve an improved utilization of the clearance when the railway vehicle is traveling around a curve.

One disadvantage of this arrangement and method is that it requires a permanent and restricted control of the center pivot, because the forces resulting from the buckling must be completely isolated from the truck.

SUMMARY OF THE INVENTION

The object of the invention is to create a method and railway vehicle which make it possible to control the car bodies so that during dynamic travel, the car bodies are in a position in relation to one another which corresponds to the static position in the corresponding track segment.

In a method and a configuration as claimed by the invention, the curvature of the track in the vicinity of the contact points with the truck is determined from the articulation angle at the center pivot measured during the travel of the railway vehicle and from the torsional angle on the respective truck, as well as from the known distance between the center pivot and the respective virtual center point of the truck in question, and stored. This same measurement procedure is repeated for the respective subsequent differential track segment, and the resulting coordinates for this partial track segment are again stored. This measurement and storage of measurements takes place at least over a distance that lies between the first and the last truck of the multiple-unit railway vehicle. In the track segment thus simulated, therefore not only is the point at which the first truck is located determined, but also the points at which the one or more following trucks are located. Once the curvature of the track segment at these additional points is contained in the storage sequence, the current actual position for all the current contact points of the trucks is known, after the trucks have entered the track segment in question.

To find the actual position of the trucks, the set point position of the car bodies must be determined as it occurs under static conditions, when the railway vehicle is at this point. In the static set point position, the clearance is minimized. In this static set point position, moreover, the energy stored in the secondary springs as a result of the torsion and transverse displacement of the car body with respect to the truck is at its minimum. The set point position of the car bodies in relation to one another can thus be determined on the basis of the minimum energy stored in the secondary spring elements and can be output as a set point angle for the position of the center pivot and the truck with respect to the car bodies as corresponding set point signals. The set point position and the corresponding set point signals are then compared to the actual position or the actual value signals for the articulation angle and the torsional angle, and on the basis of this comparison, a system of actuators is controlled which counteracts any difference between the set points and the actual values. Therefore the actual values of the articulation and torsional angles are first evaluated for a determination of the curvature of the track, from that value the static set point position of the car bodies is determined in relation to the current track segment, compared to the actual values previously determined, and on the basis of that comparison, a control signal for the system of actuators is generated to bring about a correction of the difference between the set points and the actual values.

If active force-dispensing actuator elements are used during this process, when the actual value lags behind the set point, a force component can be exerted on the car bodies in the vicinity of the center pivot or between the car bodies and the corresponding truck that accelerates the car bodies toward the set point position, and if the actual value exceeds the set point value, these actuators can also exert a force in the opposite direction. On the other hand, if controllable dampers are used, then these dampers can be used in the event of a change in the actual position that moves away from the set point position to counteract any further change of the actual position in the same direction. The damper elements are accordingly active only as long as the actual value is moving away from the set point after the set point has been reached. Changes of the current actual value toward the set point, on the other hand, are not damped.

The control system claimed by the invention is advantageous in particular if the car bodies are pushed into an unusual and/or hazardous V or Z position with respect to one another and are in danger of jumping the track as a result of brake failure, failure of the drive unit on a leading truck or similar malfunctions.

To determine the curvature of the track, the difference between the distances traveled by the track wheel of the first truck on the inside of the curve and the track wheel on the outside of the curve can be measured, and that value can be used to determine the radius of curvature of the track in the vicinity of the first truck in the direction of travel. The values determined in this manner are in turn stored in the form of a measurement sequence at least for the current segment of track between the first and last truck, in particular in the form of measurements plotted on a system of coordinates, so that the data or measurement sequence stored simulates the current curvature of the track that is being referenced for the determination of the set point position of the car bodies. The difference between the distances traveled can be determined from the different speed of rotation of the track wheels on the inside and the outside of the curve, by optical odometers or odometers that use radar or ultrasound. It is also possible, however, to evaluate the transverse displacement, the inclination and the speed of travel of the first car body to determine the curvature of the track and to store the radius values for differential track segments in a sequence for a simulation of the track segments over which the train is currently traveling.

For the technical processing, a current value signal that is a function of the angular position is generated for the articulation angle that results from the current position of the car bodies and for the torsional angle between the car body and the truck. Separate electrical set point signals are generated corresponding to the set point position of the car bodies calculated from the simulation of the current track, for the resulting set point values of the articulation angle and the torsional angle. These current value and set point value signals are compared, preferably electrically or digitally, and from the result a control signal is derived that controls the system of actuators that are operated to assist in bringing the current actual value signal closer to the corresponding set point signal, or to counteract an overshoot or undershoot. If a system of actuators with a damper characteristic is used, the system of actuators is regulated so that only changes of the actual value that are moving away from the set point are damped. The damping action can thereby be regulated as a function of the gradient of the change, so that the damping value is high at high rates of change. The system of actuators can thereby have actuator elements that are located at least in the vicinity of the center pivot, between the two neighboring car bodies and/or also between the truck and the corresponding car bodies. Preferably, the system of actuators is laid out symmetrically with respect to both the center pivot and the respective truck.

If the multiple-unit railway vehicle consists of two cars that are connected by means of a center pivot, in which the two pairs of cars are connected by means of a drag link that pivots on both ends and is located between the second and third cars, then in this case it is appropriate if the curvature of the track over the entire length of the railway vehicle is also stored and the set point position is determined separately for each pair of cars, whereby the basis for this determination is also the minimum of the energy of the respective pair of cars stored in the secondary spring elements.

The invention is explained in greater detail below with reference to the accompanying schematic drawings of one embodiment, in which:

DETAILED DESCRIPTION OF THE PREFERRED EMBODIMENTS

Figure 1:
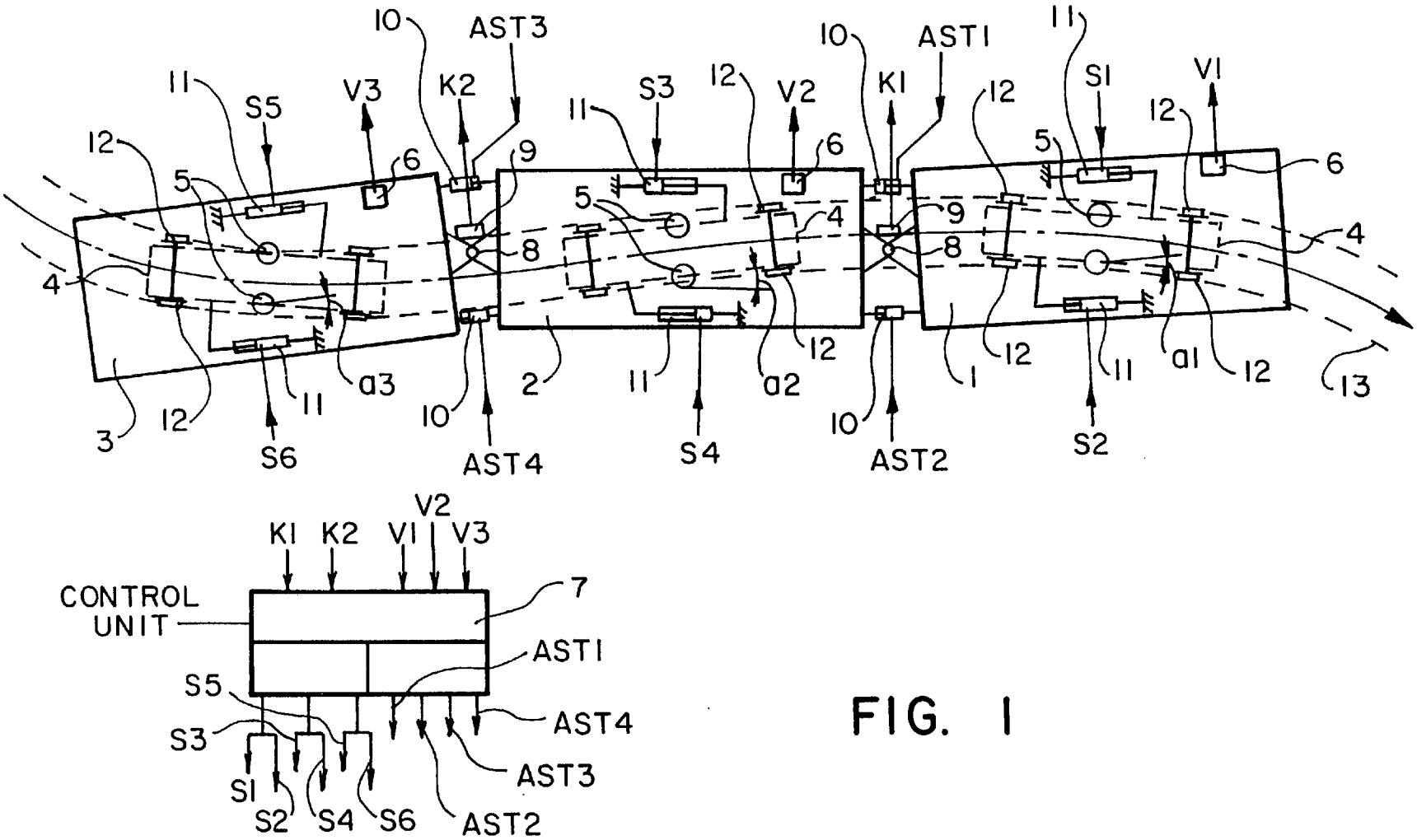
FIG. 1 shows a railway vehicle consisting of three cars with corresponding control elements on a curved section of track.

On a railway vehicle, there are three car bodies 1, 2, 3, each of which sits on only one two-axle truck 4, each by means of two elastic secondary spring elements 5 which, for their part, are located on a line that is oriented at right angles to the longitudinal axis of the respective car body, and which, in addition to their vertical spring characteristic, also permit a twisting around a vertical axis and a transverse displacement. The respective car bodies 1, 2, 3 can thereby be twisted in a plane that lies parallel to the corresponding truck 4 to a limited extent and can be displaced laterally. A displacement of the truck 4 in the longitudinal direction of the car body is thereby prevented by at least one drag link that can pivot in the longitudinal direction on the truck 4 and on the car bodies 1, 2 3, which drag link transmits the traction forces between the truck 4 and the car bodies 1, 2, 3 that occur in the longitudinal direction of the car bodies. The secondary springs 5 thus make possible a twisting of the longitudinal axis of the truck with respect to the longitudinal axis of the corresponding car body by the angle a, and are generally of different sizes on the individual cars. To measure this angle a, there are respective torsional angle sensors 6 which are connected on one hand to the corresponding car bodies 1, 2, 3 and on the other hand to the corresponding truck 4.

The torsional angle sensors 6 generate torsional angle actual value signals V1, V2, V3 as a function of the respective torsional angle a, which actual value signals are transmitted and used as the input signals of a control unit 7. The car bodies 1, 2 and 2, 3 respectively are pivotably connected by means of a center pivot 8 with a corresponding articulation angle sensor 9, whereby the center pivot 8 is the only coupling between the neighboring car bodies. The articulation angle sensor 9 generates an actual value articulation angle signal K1 or K2 as a function of the articulation angle between the longitudinal axes of the corresponding car bodies, which actual value signals are transmitted and used as the input signals for the control unit 7.

To influence the articulation angle on the individual center pivots 8, there is a system of actuators with controllable actuator elements 10 laid out symmetrically with respect to the respective center pivot 8 between the facing ends of the neighboring car bodies, by means of which actuator elements a force component can be generated between the neighboring car bodies. Additional corresponding actuator elements 11 are located in a symmetrical arrangement and are effectively connected on one hand to the respective truck 4 and on the other hand to the corresponding car bodies 1, 2 and 3 respectively. Each actuator element 10 is equipped with an actuator control input AST which is connected to the respective actuator control outputs AST 1 to AST 4 on the control unit 7. The actuator elements 11 also have control inputs S which, for their part, are connected to corresponding control outputs S1 to S6 of the control unit 7. The control inputs for the actuators 11 of a truck 4 can thereby be connected in parallel, to prevent an asymmetrical twisting of the truck under the action of these actuators 11.

Figure 2:
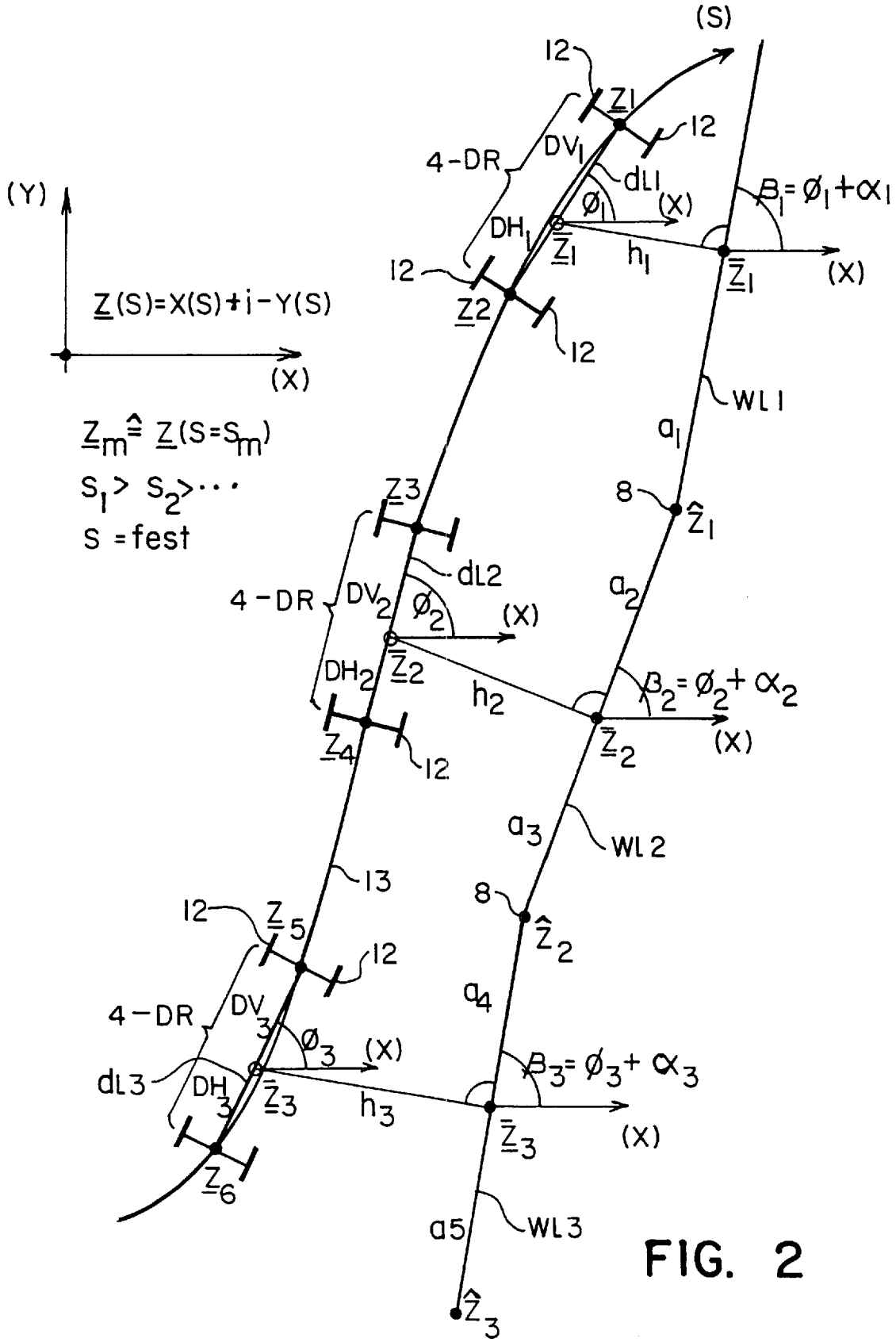
FIG. 2 is a schematic illustration of the system illustrated in FIG. 1, with reference to a rectangular system of coordinates.

The wheels 12 of the two wheel sets of each truck 4 run on the tracks 13 so that the corresponding truck is forced to assume a position defined by the section of track over which it is currently traveling. This position corresponds essentially to the tangent to the curved track segment 13 in the vicinity of the respective truck 4. As a result of the fact that the car bodies 1, 2, 3 are coupled only at the respective center pivot 8, these car bodies cannot be freely oriented as a function of the position of the truck. Consequently, there is a twisting of the secondary springs 5 around a vertical axis, and as a rule also a slight displacement at a right angle to the longitudinal axes of w1. The angular position of the individual car bodies 1, 2, 3 with respect to the longitudinal axis d1 of the corresponding trucks 4 is shown in FIG. 2. FIG. 2 also shows, although on a greatly enlarged scale, the transverse displacement h that occurs with the twisting between the longitudinal axis of the car bodies w1 and the longitudinal axis of the truck d1, which is also generally of different magnitudes on the individual car bodies 1, 2, 3. This twisting and transverse displacement must be absorbed by the respective pairs of secondary springs 5, i.e. the secondary springs 5 store the energy that results from these movements. Under static conditions, i.e. when the railway vehicle is stationary, the sum of these individual energies assumes a minimum value. When the train is in motion, this energy increases as a result of the additional dynamic forces involved. Accordingly, the clearance required by the entire railway vehicle during static operation is a minimum, and when the train is in motion the clearance reaches values that can exceed the clearance corresponding to static operation. To counteract this phenomenon, the vehicles are controlled so that under dynamic conditions, i.e. when the train is in motion, and as a function of the segment of track over which the cars are currently traveling, the car bodies 1, 2, 3 are placed in a position that corresponds to the static conditions by means of the actuators 10 and possibly also 11. As part of this process, the curvature of the track is measured and simulated at least over a length that lies between the first and last trucks of the railway vehicle running on the track segment 13. For this track segment, which is continuously updated as the train continues to move, the set point position of the car bodies with respect to one another is determined which, as explained above, is the position they would assume with respect to one another under static conditions, i.e. in stationary operation, with respect to the track, taking into consideration the contact points of the trucks with respect to one another. By a comparison of the current actual position of the car bodies with respect to one another with the corresponding set point position determined from the curvature of the track segment, the difference is counteracted as a function of the result of the comparison, at least if the actual value is moving away from the set point value. This procedure is appropriate if the actuators used for the mechanical control are controllable dampers that reduce mobility in the vicinity of the center pivot and/or between the respective truck and car body. In this case, hydraulic dampers in particular are used, the damping characteristic of which is dependent on the speed of adjustment. If force-dispensing actuators such as hydraulic cylinders or motor-driven spindle drives are used, then controlled force components can be introduced between the car bodies or between the truck and the corresponding car body which actively move the articulation angle and/or the torsional angle toward the set point, and if the actual value is greater than the respective specified set point value, also counteract this change by changing the direction of force.

The curvature of the segment of track over which the cars are currently traveling can be determined in a number of different ways. For example, it is possible at a constant cadence, i.e. in a plurality of steps, to continuously determine the current articulation angle between the longitudinal axes of two neighboring car bodies and the torsional angle at least between the first truck in the direction of travel and the corresponding car body, and from these angles and the specified distances between the center pivot and the two neighboring trucks, to determine the radius of curvature of the segment of track in the vicinity of the first truck for the current differential track segment at that point. A differential track segment is thereby a short section of track, compared to the length of the segment between the first and last trucks. For this differential track segment, measurements plotted on a system of coordinates are also taken, and these measurements are continuously stored at least for the segment of track that lies between the first and last trucks as a simulation of the corresponding track segment. The values for track segments that lie behind the last truck in the direction of travel can each be deleted if the track segment as a whole is no longer to be traveled over by additional trains which do not have their own line profile measurement systems.

The curvature and profile of the track, however, can also be determined from the difference between the distances traveled by the wheels on the rail on the inside of the curve and the rail on the outside of the curve, whereby this difference is used to determine the radius of curvature of the track in the vicinity of the first truck in the direction of travel, and the measurements plotted on a system of coordinates are thereby derived for the corresponding differential segments and can be stored as a digital simulation of the distance traveled in the form of a series of measurements. The difference in the distances traveled can thereby be determined by a measurement of the number of rotations on the idler wheel of the first truck on the inside and the outside of the curve, or by ultrasound or radar distance measurement devices. The curvature and profile of the track, however, can also be determined from the transverse acceleration, the inclination of the car body and the speed of travel, by determining the radius of curvature of the track from these values and for corresponding differential track segments, again storing the measurements plotted on a system of coordinates as the curve profile in a multi-cell memory.

For the determination of the current set point position of the car bodies 1, 2, 3 with respect to the current profile of the track 13 stored in the memory, the initial assumption is that in the static idle position corresponding to the set point position, the secondary springs 5 of the car bodies connected to one another by center pivots 8 are at an overall energy minimum with respect to their twisting around a vertical axis and a transverse displacement. Accordingly, in a digital calculation based on an algorithm corresponding to the current curvature of the track segment, preferably a determination is made of the angles at which neighboring car bodies must be with respect to one another in the set point position, or their trucks with respect to the car bodies. Therefore, the set point signals for the articulation angle between the longitudinal axes of the neighboring car bodies corresponding to the set point position are determined. Analogously, for the determined set point position, the corresponding set point signals are also generated for the torsional angle between the truck and the corresponding car body by digital data processing.

The actual position of the car bodies results from the articulation angle and the torsional angle(s), as they are actually measured by the articulation angle sensor 9 and the torsional angle sensor 6, and as they are output, in particular in the form of electrical actual value signals K and V respectively, and transmitted to the control unit 7 for further processing.

In the control unit 7, the actual value signals are compared to the set point signals, and the actuators 10 and possibly 11 are controlled as a function of this comparison. The actuators 10, 11 can thereby be controlled so that for actual value signals that lag the set point values, which result from the articulation or torsion forces between the corresponding car bodies or between the truck and the car body and caused by the dynamics, are supported so that the actual value signals approach the set point signals or so that, if the actual values exceed the set point value, the actuators are controlled in the opposite direction. On the other hand, if the actuators are realized in the form of only damping elements, an active support of the rotational movements for a more rapid approximation of the actual values to the set point values is not possible, but if the actual value has reached the set point value and then continues to move away from the set point, there is a damping of the corresponding car body movement. As soon as the actual value then again comes closer to the set point value, this damping is neutralized, so that the car body actual position can come as close as possible to the set point position without any hindrances.

Each actuator system 10, 11 preferably has actuator elements that are oriented symmetrically in twos with respect to the corresponding center pivot 9 and/or to the trucks 4. While the actuators 11 on the truck 4 must each work in the same direction to achieve a symmetrical twisting with respect to the corresponding car body, and therefore for each truck 4 can be connected to a common output S1/S2, S3/S4, S5/S6 of the control unit 7, the actuator elements 10 in the vicinity of the respective center pivot 9, on account of their location in a horizontal plane next to the center pivot 9 must be controlled in the opposite direction. Therefore when one of the one actuator elements 10 is extended, the other must be either idle or must be controlled in the sense of shortening the axial length.

Figure 3:
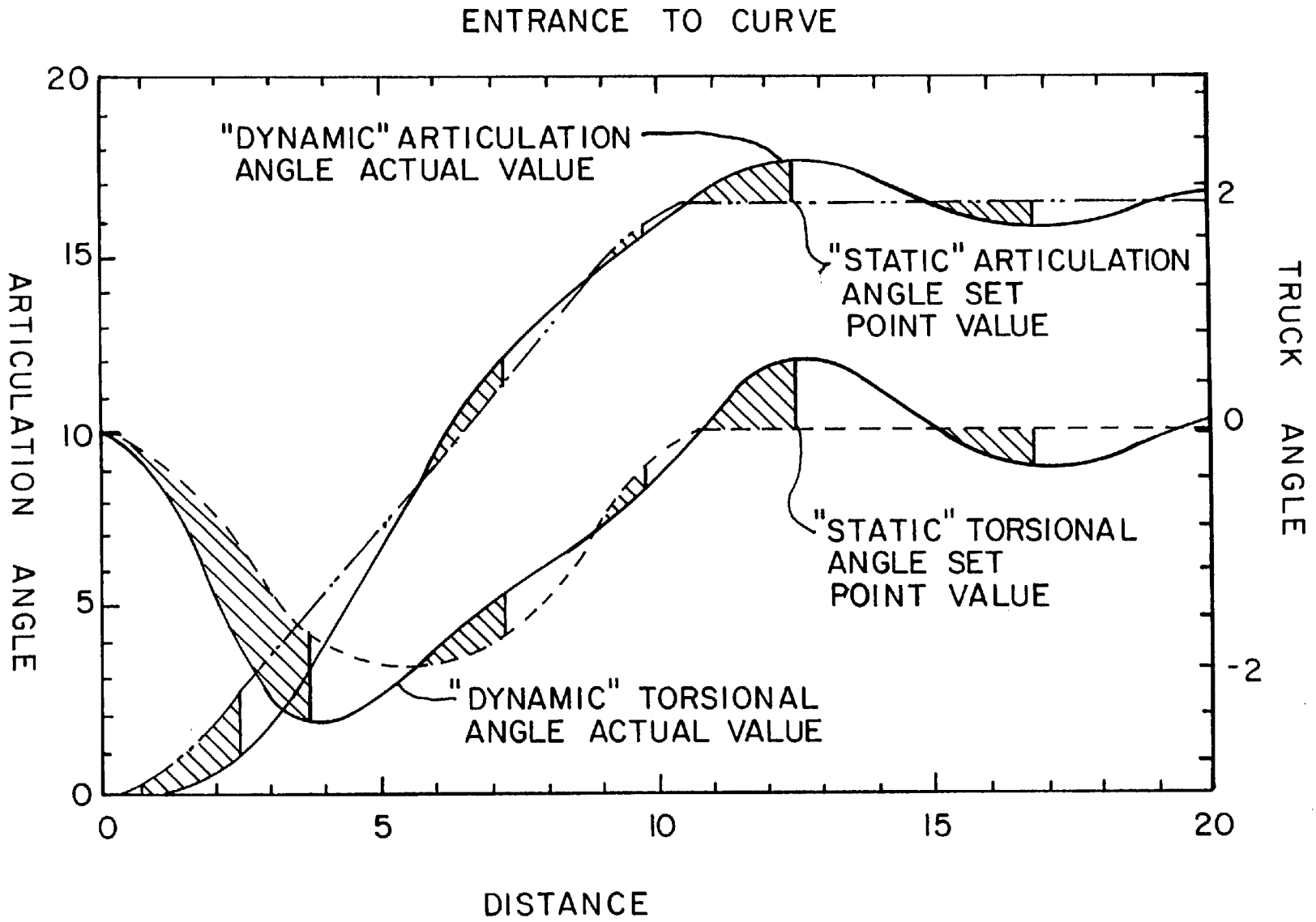
FIG. 3 is an illustration of idealized curves which are intended to be used as reference values for a dynamic curve corresponding to the actual value of the articulation angle between the first and second cars and of the torsional angle between the first car in the direction of travel and the corresponding truck, when the vehicle is traveling through a curved section of the track.

FIG. 3 illustrates the "static" articulation angle set point value in comparison to the corresponding "dynamic" articulation angle actual value, and simultaneously the "static" torsional angle set point value in comparison to the "dynamic" torsional angle actual value on the first truck in the direction of travel for a segment of track that leads from a straight section into a curve with a constant radius of curvature. The set point and actual value signals have thereby had the parasitic oscillations that occur during operation eliminated. Over the length of a section of track plotted on the abscissa, articulation angle values are plotted on the left ordinate, and torsional angle values are plotted on the right ordinate. The 0-points are thereby not at the same level.

When the first truck enters a curved section of track with a constant radius from a straight section of track, the set point of the articulation angle increases in an approximately linear fashion to a maximum until the two corresponding car bodies or their trucks are running in the curved segment. When there is no change in the radius, the articulation angle then remains constant at the maximum. The curve of the articulation angle set point therefore corresponds to the curve as it is measured point-for-point at a speed of travel approaching zero or in stationary operation. In the same manner, the torsional angle set point which is plotted in the diagram initially decreases, starting from the value zero, in the opposite direction, and then rises back to the value zero when the second truck has also entered the curve. The car bodies at that point are at least largely tangential to the curved rail.

The curve of the line of the articulation angle set points is calculated from the curve of the track over which the train is currently traveling on the basis of the smallest of the total energy content of the transverse and torsional forces of the corresponding secondary spring elements to be taken into consideration, and can preferably be stored as a progressive sequence of set points for the corresponding differential track segments. The set point for the torsional angle is determined in an analogous manner.

The articulation angle actual value that is assumed when the train travels over the track segment in question without the influence of the actuators begins of course at the value zero when the train enters a curved section of track from a straight line, and as a result of its mass inertia increases with respect to the set point with some delay. The mass inertia, however, then prevents the termination of the increase in the articulation angle actual value when the actual value equals the set point, and thus results in the actual value overshooting the set point, as illustrated schematically by the line that rises above the set point.

Unless the articulation of the longitudinal axes of the car bodies are assisted by actuator elements that actively apply a force to bring them closer to the set point even before the maximum value is reached, when actuators with a damping characteristic are used, the overshooting of the articulation angle is only counteracted when the actual value exceeds the set point. If necessary, the damping action can also be initiated when the actual value is only a short distance away from reaching the set point. The damping of the increase in the articulation angle after the actual value has exceeded the set point is illustrated by the shaded area pointing upward in the overshooting curve, whereby the damping action is continued only as long as the actual value is moving away from the set point. By a correspondingly strong damping, the level of the overshooting curve is significantly reduced, ideally to the value zero. The descending branch of the overshooting curve is not damped, to avoid delaying the approximation to the set point value. When the actual value falls below the set point, as illustrated by the curve that drops below the set point, there is also a damping of the articulation angle reduction after it reaches the set point, to also reduce this undershoot to a minimum. The curve segment that then runs toward the set point is in turn not damped. A damping of differences between the set point and current value is thereby performed only when it exceeds certain specified limit values, so that small, normal operational angular differences are tolerated.

The curve of the actual value of the torsional angle under dynamic operating conditions illustrated by the dotted line initially follows, at an increased amplitude, the curve of the torsional angle set point value which is also calculated from the track geometry, so that after returning to the value zero, it can also oscillate beyond the value zero as a result of the mass inertia of the car bodies. To the extent that this overshooting cannot already be limited to harmless levels by means of the actuators in the vicinity of the center pivot, the actuator elements 11 are used, which act between the truck 4 and the corresponding car bodies 1, 2 or 3. It thereby becomes possible, by means of actuator elements 11 that apply active force, e.g. hydraulic cylinders or electric actuators, to counteract the negative rebound beyond the set point. If only damping elements are used as actuators, it is only possible to counteract the overshooting or undershooting of the set point by the corresponding control of the actuators. In this case, too, a damping corresponding to the shaded field is continued only as long as the actual value, after reaching the set point, moves away from the set point in a positive or negative direction. Movements of the truck with respect to the car body that approach the set point, however, are not damped. Here again, it is possible to initiate the damping shortly before reaching the set point, to reduce the overshoot to a minimum.

Corresponding control methods can also be carried out using the actuators if the railway vehicle leaves the curved section of track, and corresponding oscillation processes become active, in the opposite direction, in the straight section of track.

When the car bodies are controlled by influencing the articulation angle between the longitudinal axes of the car bodies, possibly with assistance by the system used to control the position of the trucks with respect to the car bodies, the positions of the car bodies with respect to one another can be controlled so that an orientation of the car bodies with respect to one another under dynamic conditions is achieved that is at least approximately the same as under static operating conditions, so that the railway vehicle overall has a clearance requirement that approaches the actual track curvature and in particular remains within this clearance requirement if malfunctions in the braking and/or drive elements or other factors could lead to thrust or shearing forces that could cause the coupling to buckle.

What is claimed is:

1. A method for influencing the articulation angle between longitudinal axes of neighboring car bodies of a multi-unit railway vehicle traveling on a track, the car bodies of which are each elastically mounted by means of secondary springs on only one two-axle truck, and each two neighboring car bodies are pivotably coupled to one another by means of a single center pivot, comprising the steps of:

measuring a curvature of a track segment at least over a length that lies between a first truck and a last truck;

simulating the curvature of the track segment at least over a length that lies between the first truck and the last truck;

determining a set point position of the car bodies with respect to one another corresponding to the car bodies' static position at rest; and comparing current set point position of the car bodies with an actual position, wherein, as a function of the comparison of the set point position of the car bodies with the actual position, at least one of the following occurs, actions are taken to counteract a difference between the set point and the actual position, and when the actual position is changing in the sense of moving away from the set point position, a further change of the actual position in the same direction is counteracted.

2. The method of claim 1 wherein the current set point position of the car bodies with respect to the curvature of the track over which the vehicle is currently traveling is determined by determining the corresponding static rest position of the car bodies based on the assumption that the energy that results from the displacement of the trucks with respect to the car bodies is stored in the secondary springs and reaches a minimum for the current location of the vehicle.

3. The method of claim 1 wherein the curvature of the track is determined by continually measuring the current articulation angle between the longitudinal axis of neighboring cars, as well as a torsional angle between the truck and the corresponding car body, and from these angles and the specified distances between the center pivot and the two neighboring trucks, the radius of curvature of the track in the vicinity of the first truck is determined for a current differential track segment at that point, and that the values determined continuously for the segment of track between the first and last trucks are stored in the form of measurements plotted on a system of coordinates.

4. The method of claim 1 wherein the curvature of the track is determined from the difference between the distances traveled on the inside rail and on the outside rail of the curve, where the radius of curvature of the track in the vicinity of the first truck in the direction of travel is determined, and the values determined continuously at least for the section of track lying between the first and last trucks are stored in the form of measurements plotted on a system of coordinates.

5. The method of claim 1 wherein the curvature of the track is determined from the transverse acceleration, the inclination and the speed of travel of the car body, where the current radius of curvature of the track is measured at the first truck, and that the current values determined continuously at least for the track segment lying between the first and the last trucks are stored in the form of measurements plotted on a system of coordinates.

6. The method of claim 1 wherein the set point position is defined corresponding to the set point position determined for the articulation angle between the longitudinal axes of the neighboring car bodies.

7. The method of claim 1 wherein the set point position is defined corresponding to the set point position determined for the torsional angle between the truck and the corresponding car body.

8. The method of claim 1 wherein the current set point position is determined by converting the current articulation angle between the longitudinal axes of the car bodies into actual value signals.

9. The method of claim 1 wherein the current set point position is determined by measuring the current torsional angle between the truck and the corresponding car body and converted into actual value signals.

10. The method of claim 1 wherein current value signals are compared to set point signals, and in the event of a change of the corresponding actual value signal that is moving away from the respective set point signal, a controllable actuator system that corresponds to the center pivot is activated and counteracts a continued change of the actual value signal in the same direction.

11. The method of claim 1 wherein actual value signals are compared to corresponding set point signals, and in the event of a difference of the actual value signals from the corresponding set point signals, at least one controllable actuator system corresponding to the center pivot is activated, so that the actual value is moved closer toward the corresponding set point.

12. A multi-unit railway vehicle, comprising:

a plurality of car bodies, each of said bodies elastically mounted to a corresponding two-axial truck by means of a plurality of secondary springs;

a plurality of single center pivots, said pivots pivotally coupling said car bodies to one another;

an articulation angle sensor on each of the single center pivots;

a torsional angle sensor at least between a first truck and the corresponding car body;

a control unit connected to the articulation and torsional angle sensors; and a controllable actuator system on the center pivot, between the neighboring car bodies, wherein the angle sensors emit actual value signals that are transmitted to the control unit which, in a first control step, generates and stores a simulation of the track segment over which the train is currently traveling from the actual value signals of the angle sensors and the geometric dimensions between the center pivot and the neighboring trucks, and on the basis of the lowest energy of the secondary spring elements for the static operation of the car bodies, generates set point signals for the articulation angle and the torsional angle, and compares the actual value signals with the corresponding set point signals, at least one controllable actuator system is provided on the center pivot, between the neighboring car bodies or between the truck and the corresponding car bodies, and the actuator system is controlled through the control unit as a function of the comparison of the actual and set point signals.

13. The railway vehicle of claim 12 wherein the actuator system is a controllable damper system.

14. The railway vehicle of claim 12 wherein the actuator system is oriented symmetrically with respect to both the center pivot and the respective truck, where the damper elements are controlled so that the actual value of the car body position is approximated to the set point value.

15. The railway vehicle of claim 12 wherein the actuator system has two damper elements that are oriented symmetrically to the pivot, where the damper elements are controlled so that the actual value of the car body position is approximated to the set point value.

16. The railway vehicle of claim 12 wherein the actuator system has two damper elements that are oriented symmetrically to the trucks, where the damper elements are controlled so that the actual value of the car body position is approximated to the set point value.

17. The railway vehicle of claim 12 further comprising a distance sensor located on one of the first car body and the first truck, said distance sensor generating separate signals for differential lengths of the track segments, that for these differential track lengths, the respective changed coordinate values are determined, and that for the distance signals, the corresponding coordinate values of the track length segments are stored in a memory unit of the control unit as the profile of the segment of track currently lying between the first and last trucks.

18. The railway vehicle of claim 17 wherein the control unit determines the current radius of curvature of the differential track segment on the first truck, or the first car body, the respective current articulation angle actual value signal and the specified mechanical distances between the coupling and the trucks of the neighboring car bodies, including the torsional angle of the trucks with respect to the corresponding car body, and from that value determines the current coordinates themselves.

19. A control device for influencing an articulation angle between longitudinal axes of neighboring car bodies of a multi-unit railway vehicle traveling on a track, the car bodies of which are each elastically mounted by means of secondary springs on only one two-axle truck, and each two neighboring car bodies are pivotably coupled to one another by means of a single center pivot, comprising:

means for storing an algorithm for determining the minimum energy stored in the secondary springs derived from an actual value of at least one articulation angle and a torsional angle and referenced to a predetermined track segment;

means for generating set points for the articulation angle and torsional angle; and means for controlling an actuator system of the multi-unit railway vehicle that counteracts deviation of the car bodies from the set points.

20. The control device of claim 19 wherein the algorithm for determining the minimum energy stored in the secondary springs derived from the actual value of at least one articulation angle and the torsional angle and referenced to a predetermined track segment is stored in said control device, and that the control device generates set points for the articulation angle and the torsional angle and controls an actuator system that counteracts deviation of the car bodies from the set points.

* * * * *